United States Patent [19]

Wooding

[11] 4,127,255

[45] Nov. 28, 1978

[54] LEVERAGE DEVICE FOR USE WITH JACK

[76] Inventor: Charles Wooding, Box 34-2, Chenoa, Ill. 61726

[21] Appl. No.: 893,330

[22] Filed: Apr. 3, 1978

[51] Int. Cl.[2] ..... B66F 3/22

[52] U.S. Cl. ..... 254/133 R; 254/8 B; 254/124

[58] Field of Search ..... 254/133 R, 8 R, 8 B, 254/122, 124, 120, 131

[56] References Cited

U.S. PATENT DOCUMENTS

| | | | |
|---|---|---|---|
| 1,684,606 | 9/1928 | Thielen | 254/124 |
| 2,080,114 | 5/1937 | Cochin | 254/8 B |
| 3,378,231 | 4/1968 | Rapp | 254/8 B |

*Primary Examiner*—Robert C. Watson

*Attorney, Agent, or Firm*—Cushman, Darby & Cushman

[57] ABSTRACT

A leverage device for use with various jacking means may be folded to occupy a minimum of space during storage but can be unfolded and set in an operative condition to be made fully functional to cooperate with various conventional jacking devices, the device providing a scissoring action for raising and lowering an object when the jack is actuated.

10 Claims, 3 Drawing Figures

LEVERAGE DEVICE FOR USE WITH JACK

PRIOR ART

Typical of the devices known in this field include those shown in the U.S. Pat. Nos. 3,780,987, to Craft, Dec. 25, 1973; Rapp, 3,378,231, Apr. 16, 1968, and Schneider, 3,222,032, Dec. 7, 1965.

All of these patents show various forms of low-profile leverage means or linkage systems designed to cooperate with jacking means built into or forming a permanent part of the jacking means. By low-profile is meant that the portion of the device which fits under the object to be lifted has a lesser height than the jack which provides the lifting power. Craft and Rapp provide scissoring leverage means powered by hydraulic or pneumatic jacking means forming a permanent part of the combination making for a somewhat bulky arrangement even in a collapsed storage position. Schneider shows a somewhat different type of linkage mechanism with an electrically powered drive means. As with Craft and Rapp, the Schneider device cannot be collapsed or folded into a very thin arrangement for storage, for example, in the trunk of an automobile, and as with the other prior art patents, Craft shows a device that would be heavier to handle because of the added weight of the integral power means.

BRIEF DESCRIPTION OF THIS INVENTION

The present improvement on the prior art provides a scissoring leverage system that can be folded into a very compact space and yet can be easily unfolded and arranged to coact with any one of a number of conventional jacking means to lift an object. In the preferred form here shown, the structure is designed to be folded so as to occupy a very small space so that it may be easily stored, for example, in the trunk of an automobile to be readily available for use with a separately stored hydraulic or mechanical jack.

The elongated scissoring leverage means here shown makes use of nested lever means having a pivot near the middle of their lengthwise dimension. At the jack engaging end of the lever system, a folding bail means is hingedly connected to one lever and the other lever has a bearing pad integral with it. In its stored position, the bail is folded down to lie in a position surrounding the end of the leverage system; in use it is raised upwardly into a position over the bearing pad on the other lever means. Any form of conventional jack may then be placed on the bearing pad to engage with the bail means. When the jack is operated, the levers are driven to cause the system to open like a pair of scissors.

The lifting end of the lever system that is the opposite end from the jack engaging end, has foot pad means integral with one of the levers and an object engaging pad means formed integral with the other lever. The pads are interfitted in their stored or inactive position to provide a thin bearing means that protrudes from the end of the leverage system for placement under the object to be lifted. These respective foot and object engaging pads integral with the respective levers, are adapted to be spread apart one relative to the other as the jack is driven in order to raise the object.

When the lifting operation has been completed, the jack can be operated to lower the object, for example, an automobile, so that the levers return to their nested relationship and the jack may be removed from engagement with the leverage system. The pad means can be pulled from under the object and the bail can then be folded into its aligned position with the nested levers to produce a leverage means that occupies a space having a minimum thickness so that the nested levers can be locked together for storage in a relatively limited space. The jack means is removed from the system before it is folded for storage so that the jack can be stored separately.

It is therefore an object of this invention to provide an improved scissoring type leverage system for lifting objects.

It is another object of the invention to provide a folding leverage system that occupies a minimum of storage space.

Another object is to provide a scissoring leverage system having separable jacking means for convenience in storage.

These and other objects will be explained more fully in the specification below.

IN THE DRAWINGS

DETAILED DESCRIPTION

Figure 1:
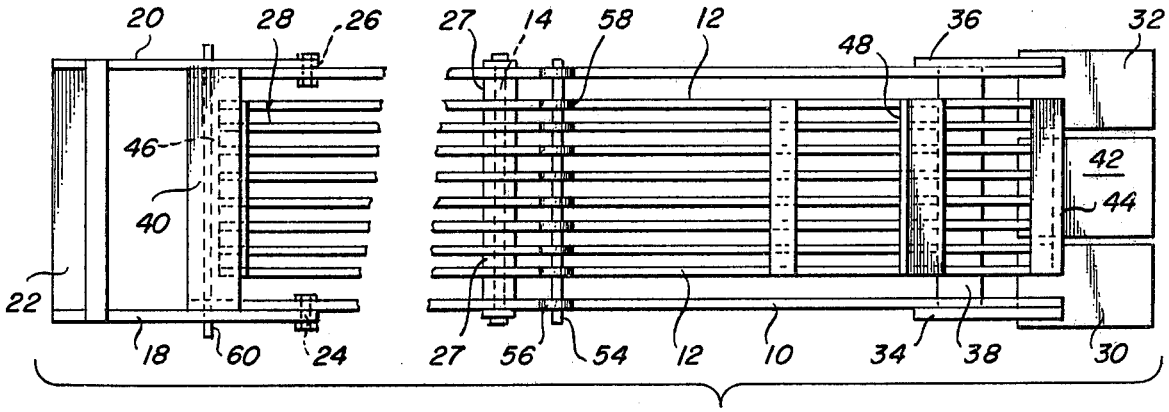
FIG. 1 is a top plan view partly broken away, showing the leverage system in its folded condition.
Figure 2:
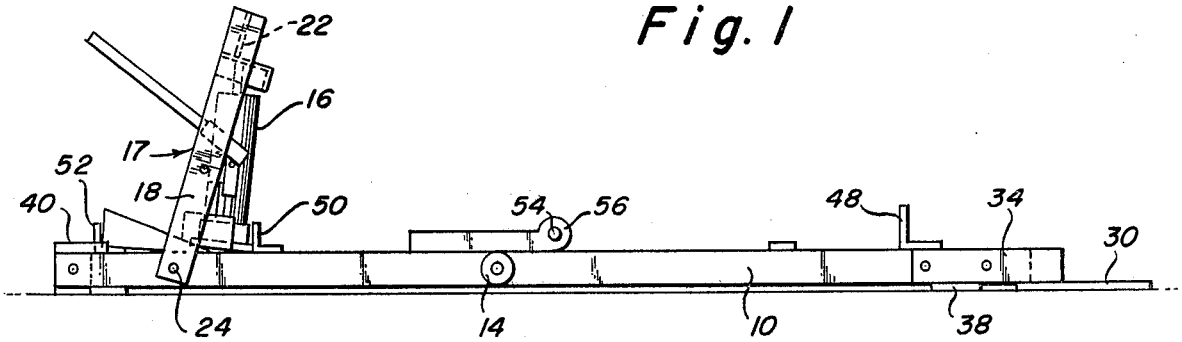
FIG. 2 is a side elevation with a jack in place at the operative end of the leverage system.

In its preferred form, the scissoring leverage system shown herein includes an outer lever 10 and an inner lever 12 nested within lever 10 in the folded position of the system, as shown in FIGS. 1 and 2. The outer lever 10, as shown, is made in the form of a stiff, hollow, rectangular frame that is interengaged with the inner lever means 12 by a bearing axle 14 that extends through the nested levers at about their midpoint lengthwise of the levers. The inner lever is rigid structure made up of an assembly of a plurality of bar elements stiffened by cross braces welded thereto, the assembled spaced bars forming a smaller rectangular structure that easily fits within the space defined by the walls of the frame forming the rectangular lever 10 so that the two levers can be oscillated about axle 14 to act like a scissor when their ends are moved apart at one end as can be done with the motion of a jacking means in order to lift an object engaged on the end of the elevated lever at the other end of the system.

Figure 3:
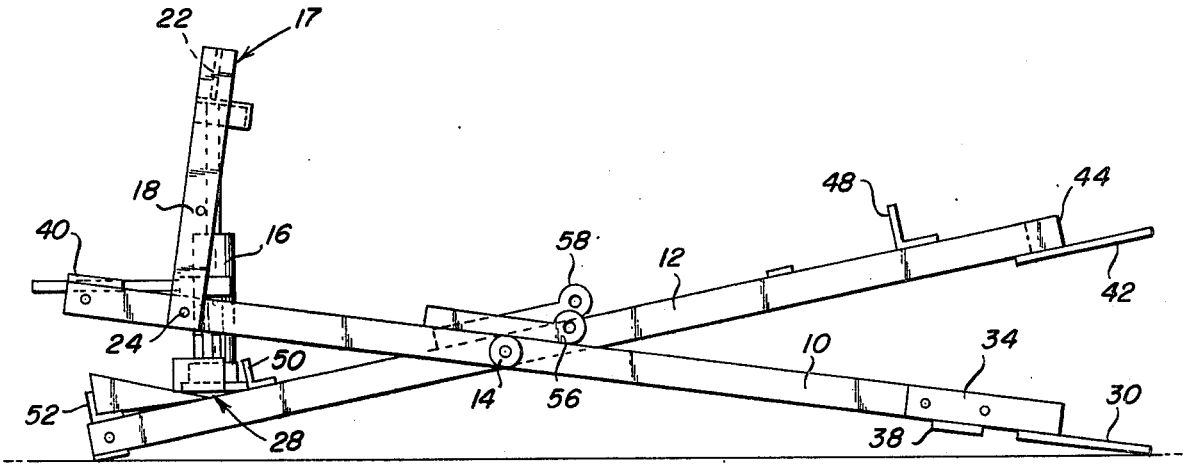
FIG. 3 is a side elevation showing the jack in its extended condition with the scissoring leverage system open, showing the motion used to lift an object.

At their operative ends, the levers are adapted to cooperate with a jack means 16 and, for this purpose, there is a U-shaped bail, generally denoted 17, that has side arms 18 and 20 that are connected by stiff cross piece 22. The open ends of side arms are pivotally attached by hinge pins 24 and 26 to the outside of frame 10 near the operative end thereof, so that the bail can rotate from a standing position to a folded position over the end of the frame with cross piece 22 fitting over the end of the lever 10, as shown in FIG. 1. The U-shaped bail is adapted to be rotated from its folded position in line with lever 10 to a generally upright position standing at about right angles thereto, as shown in FIGS. 2 and 3.

The lever 12, as above described, is rectangular and is a composite frame structure that is made up of a plurality of longitudinally extending identically shaped bars that can be formed from a somewhat lighter weight metal than the thicker bar stock used for making the frame forming lever 10. The composite bar structure of lever 12 has internal spacers 27 supported on axle 14 and positioned between the bars. Lever 12 may also have one or more stiffening flanges welded thereto to render this lever sufficiently stiff to support the heaviest load for which the scissoring leverage system is designed to cooperate. At its operative end, lever 12 has a surface area 28 that provides a floor or support for the base of jack 16. The pivots 24 and 26 for the bail 17 are positioned to be spaced along the side walls from the end of the frame 10 a sufficient distance such that the cross bar 22 of the bail is disposed over the surface or floor means 28 when the bail is in its raised position.

At the other or lifting end of the leverage system, opposite from the operative end, the flat foot pads 30 and 32 are welded to the vertically disposed side supports 34 and 36 that are adapted to be bolted to the opposite sides of lever 10 respectively to provide spaced apart bearing supports for the object lifting end of the leverage system. The pads 30 and 32 extend under the side walls of the frame forming lever 12. The side walls of frame 10 can be supported and held spaced apart by a horizontally fitted cross bar or plate 38 welded to the underside of the vertical walls forming frame 10 for supporting the underside of lever 12 in its closed or nested position, shown in FIGS. 1 and 2. The rectangular frame forming lever 10 also includes a support at its operative end for the elongated stiff side walls to complete the stiff rectangular frame. For this purpose, the plate 40 is welded to the upper surface of the side walls of lever 10 at its operative end to extend over the top of the upper surface of lever 12.

At the lifting end of the system, the nested lever 12 has a flat object engaging pad 42 fixedly attached to its underside, the pad being of a size to interfit between the pads 30 and 32 with its upper surface in a common plane with the upper surfaces of these spaced apart foot pads, as shown in FIGS. 1 and 2 when the levers are nested together. The plurality of elongated bars forming lever 12 are designed to be stiffened and held in an assembled position by end plates 44 and 46 welded across the ends of the aligned bars forming the lever. Other stiffening means, such as the L-shaped cross pieces 48, 50 and 52, may also be welded across the top of the plurality of bars forming lever 12. The upper surface of these bars between cross pieces 50 and 52 may serve as the floor means 28 for supporting jack 16, the cross pieces 50 and 52 holding the base of the jack in position on the operative end of lever 12 when the other part of the jack is engaged under the cross piece 22 of the U-shaped bail attached to lever 10.

The levering structure described above is designed to be folded in a manner to occupy a minimum of space. The arms 18 and 20 and cross piece 22 of the U-shaped bail fit around one end of the lever structure 10 and the nested lever 12 when the leverage means is in storage and the interfitted foot pads 30 and 32 and the object supporting pad 42 all nest together at the lifting end of the system. The one lever 12 nests within the other lever 10 and the rigid outer lever fully encloses the nested lever in the storage position so that when the bail is turned to its inactive position, a very compact generally rectangular structure is provided that can be easily stored. Suitable means may be provided to hold the folded leverage means in this compact shape and, referring to FIG. 1, a means such as a rod 54 may be fitted into apertures formed in ears 56 and 58 integral with levers 10 and 12 respectively. If needed, another rod 60 may be positioned in aligned apertures in levers 10 and 12 to hold the bail 17 in its folded position.

When the system is to be put into use, bars 54 and 60 are removed and the levers are positioned adjacent the object to be lifted with foot pads 30 and 32 and the object supporting pad 42 at the lifting end of the system in position under the object. The bail 17 is then raised and any available jack means is placed upon the support 28 on the upper surface of lever 12 while the cross piece 22 of the bail is engaged over the other active end of the jacking means. When the jack is operated, it is elongated between floor 28 and the cross piece to raise the bail 17 hinged to lever 10 relative to the floor 28 that is integral with lever 12, causing the leverage system to open like a scissors, turning on axle 14 whereby the object is lifted as pad 42 is raised relative to foot pads 30 and 32. The spaced apart foot pads 30 and 32 provide a very stable base for the object as it is raised by the leverage system.

The object may be lowered by reversing the action of the jacking means 16. The levers 10 and 12 turn about axle 14 to return to their nested relationship. The pads 30 and 32 and the object support pad 42 return to their interfitted relationship when the levers are fully nested so that they may be removed from under the object and the system may be folded again to occupy a minimum of space. The locking pins 54 and 60 can be put in place and the leverage system can then be returned to its storage place. The jack being a separate element, can be stored in its usual place so that this very useful scissoring type leverage system may be comfortably stored away until needed again in the future.

It is to be noted that any form of jack means can be used that can be fitted to this leverage system. As shown, a hydraulic jack 16 is disposed between surface 28 and the cross piece 22 of the bail. It will be noted that as the levers move farther apart around axle 14, that the bail can turn about its hinged or pivotal connection with lever 10 on pins 24 and 26 to remain in a position to receive the direct thrust from the jack so that the lever spreading effort of the jack is always exerted at the best angle possible relative to each lever. The universal adjustability of the bail 17 makes it possible to fit any suitable jacking means between floor 28 and bail 17 of this leverage system whereby to obtain the desired lifting effort for transmittal to an object to be lifted.

While not intending to be limited to any specific dimensions, by way of illustration a leverage system of this design has been constructed as above described with an outer dimension of 8 inches in width, 36 inches in length and, when the bail is folded down as shown in FIG. 1, having a thickness of 2 inches. While making use of such a scissoring type leverage system, the elongated construction allows the operator to work at a convenient and safe distance from the object to be lifted while still exerting the necessary effort, within the limitations of the jack, to move the object.

The above describes the preferred form of this invention. It is possible that modifications may occur to those skilled in the art that will fall within the scope of the following claims.

What is claimed is:

1. A portable leverage system for use with various jacking means having an operative end for cooperating with a jack and a lifting end for engaging the object to be raised, comprising a pair of nested elongated rigid inner and outer frame members, said nested frames being designed to occupy a minimum of space when nested, pivot means connected between said inner and outer frames to provide lever means having a scissoring motion, a generally U-shaped lifting bail connected to an operative end of the system at one end of one of said nested frame members, the open end of said U-shaped bail being hingedly connected to the said one frame at said operative end so that the bail can rotate from a closed position within said space and in line with said nested frames to an active position generally disposed at right angles thereto adjacent to the end of said one frame, a floor means integral with the operative end of the other of said frames, a foot pad means integral with said one frame at the lifting end of said system that is opposite the operative end, an object engaging pad means integral with the lifting end of said other frame, whereby a jack can be fitted between said floor and said bail when the bail is in its active position so that upon activation of the jack said frames move through their scissoring action to raise and lower the object engaging pad away from and toward the foot pad means.

2. A leverage system as in claim 1 wherein the open end of U-shaped bail is connected to the opposite sides of said one frame.

3. A leverage system as in claim 1 wherein said bail is hinged to the outermost of said nested frame members.

4. A leverage system as in claim 1 wherein the floor means is integral with the inner of said nested frame members.

5. A leverage system as in claim 1 wherein said foot pad means and said object engaging pad are flat elements adapted to interfit.

6. A leverage system as in claim 5 wherein said interfitted pad means all lie in a plane within said space when said frames are nested.

7. A leverage system as in claim 1 wherein said foot pad means includes two spaced apart pads each being mounted integrally respectively with the opposite corners of said one frame at said lifting end of the system, and said object engaging pad means being integral with said other of said nested frames and positioned between said spaced apart foot pads when said frame members are in their nested position.

8. A leverage system as in claim 5 wherein said one frame is the outermost of said nested frames.

9. A leverage system as in claim 5 wherein said floor means is integral with the innermost of said frames.

10. A leverage system as in claim 5 wherein said bail means is hinged to the outermost of said frames and the floor means is integral with the innermost of said frames.

* * * * *